US011608728B2

(12) United States Patent
Brown et al.

(10) Patent No.: US 11,608,728 B2
(45) Date of Patent: Mar. 21, 2023

(54) PUMP SYSTEM WITH PASSIVE GAS SEPARATION

(71) Applicant: Halliburton Energy Services, Inc., Houston, TX (US)

(72) Inventors: Donn J. Brown, Broken Arrow, OK (US); Trevor A. Kopecky, Owasso, OK (US); Casey L. Newport, Tulsa, OK (US)

(73) Assignee: Halliburton Energy Services. Inc., Houston, TX (US)

( * ) Notice: Subject to any disclaimer, the term of this patent is extended or adjusted under 35 U.S.C. 154(b) by 78 days.

(21) Appl. No.: 17/219,834

(22) Filed: Mar. 31, 2021

(65) Prior Publication Data

US 2022/0316309 A1 Oct. 6, 2022

(51) Int. Cl.

| | |
|---|---|
| ***E21B 43/38*** | (2006.01) |
| ***E21B 33/12*** | (2006.01) |
| ***E21B 43/12*** | (2006.01) |

(52) U.S. Cl.

CPC ..... *E21B 43/38* (2013.01); *E21B 33/12* (2013.01); *E21B 43/128* (2013.01)

(58) Field of Classification Search

CPC ..... E21B 43/38; E21B 43/35; E21B 33/12; E21B 43/128; E21B 43/13

See application file for complete search history.

(56) References Cited

U.S. PATENT DOCUMENTS

| | | | | |
|---|---|---|---|---|
| 6,601,651 | B2 * | 8/2003 | Grant | E21B 43/128 166/66.4 |
| 3,104,534 | A1 | 1/2012 | Olson et al. | |
| 8,141,625 | B2 * | 3/2012 | Reid | F04B 47/06 166/265 |
| 10,731,447 | B2 | 8/2020 | Fehri | |
| 2010/0319926 | A1 | 12/2010 | Reid | |
| 2016/0333681 | A1 | 11/2016 | Mazzanti | |
| 2017/0058654 | A1 | 3/2017 | Ellithorp et al. | |
| 2017/0328189 | A1 | 11/2017 | Wang et al. | |
| 2020/0003041 | A1 | 1/2020 | Wang et al. | |

OTHER PUBLICATIONS

Foreign Communication from Related Application—International Search Report and Written Opinion of the International Searching Authority, International Application No. PCT/US2022/015170, dated May 13, 2022, 10 pages.

* cited by examiner

*Primary Examiner* — Catherine Loikith

(74) *Attorney, Agent, or Firm* — Conley Rose, P.C.; Rodney B. Carroll

(57) ABSTRACT

Apparatus and method for passive gas separation in a through-tubing-conveyed (TTC) pump system comprise abruptly reversing a flow direction of wellbore fluids from flowing up the wellbore to down into a liquids reservoir. The generally annular liquids reservoir is formed between a production tubing and a pump of the TTC pump system. Wellbore fluids flowing up the production tubing are diverted into the annulus via one or more outlet ports in the production tubing. The wellbore fluids flow up the annulus until encountering one or more inlet ports in the production tubing, which redirects the wellbore fluids from the annulus down into the liquids reservoir. The reversal of flow direction causes gas in the wellbore fluids to separate from liquids as the gas continues moving up the wellbore instead of changing direction with the liquids. The substantially gas free liquids are then pumped by the pump up to the surface.

20 Claims, 4 Drawing Sheets

PUMP SYSTEM WITH PASSIVE GAS SEPARATION

TECHNICAL FIELD

The exemplary embodiments disclosed herein relate to production of fluids from a well via artificial lift pump systems and, more particularly, to apparatuses and methods for passive separation of gas from fluids in wells that use through-tubing-conveyed (TTC) pump systems.

BACKGROUND

In the oil and gas industry, fluids from a subterranean formation typically contain a multiphase mixture of liquids and gas. Production of the fluids involves using an artificial lift pump system to pump the multiphase mixture from a subterranean formation up the wellbore to the surface. The artificial lift pump systems typically employ one of several available types of pumps, such as an electric semisubmersible pump (ESP), a progressive cavity pump, and similar pumps. However, gas present in the wellbore fluids can degrade the performance of the pumps. The gas, which can range from small bubbles to extended gas slugs, can accumulate in the pumps and lead to eventual "gas lock."

Gas avoidance systems are available that can separate the gas from the fluids at the pumps. However, existing gas avoidance systems are not suitable for use with certain types of artificial lift pump systems. For example, through-tubing-conveyed (TTC) pump systems require strict size constraints in order to allow the pumps to be conveyed through the tubing. The size constraints make it difficult to use existing gas avoidance systems with TTC pump systems.

Therefore, a need exists for improvements in apparatuses and methods for separation of gas from wellbore fluids in artificial lift pump systems.

BRIEF DESCRIPTION OF THE DRAWINGS

For a more complete understanding of the exemplary disclosed embodiments, and for further advantages thereof, reference is now made to the following description taken in conjunction with the accompanying drawings in which.

DESCRIPTION OF EXEMPLARY EMBODIMENTS

The following discussion is presented to enable a person ordinarily skilled in the art to synthesize and use the exemplary disclosed embodiments. Various modifications will be readily apparent to those skilled in the art, and the general principles described herein may be applied to embodiments and applications other than those detailed below without departing from the spirit and scope of the disclosed embodiments as defined herein. Accordingly, the disclosed embodiments are not intended to be limited to the particular embodiments shown, but are to be accorded the widest scope consistent with the principles and features disclosed herein.

Figure 1:
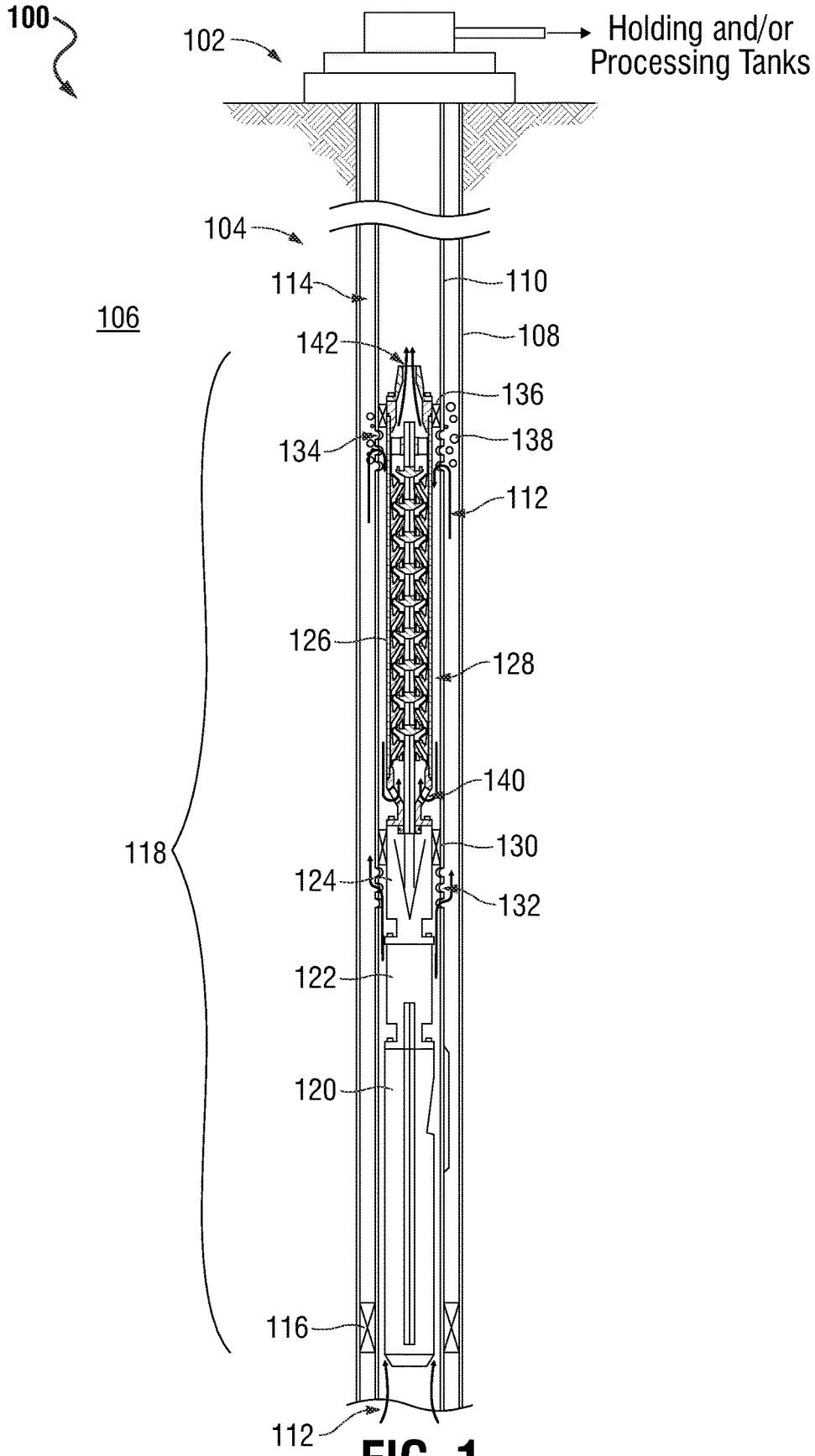
FIG. 1 is a schematic diagram of a well employing a TTC pump system with passive gas separation according to embodiments of the present disclosure.

Referring to FIG. 1, a schematic diagram of a well 100 that employs a TTC pump system with passive gas separation according to embodiments of the present disclosure is shown. The well 100 is a production well having a well head 102 at the surface and a wellbore 104 extending into a subterranean formation 106. Casing 108 is installed to provide structural support for the wellbore 104 and to protect the formation 106 from contamination. Production tubing 110 is run through the casing 108 down the wellbore 104 to produce wellbore fluids 112 from the formation 106. The production tubing 110 and the casing 108 form an annulus 114 that can be sealed off by setting a sealing element 116, such as a packer, in the annulus 114 near the fluid entrance to the tubing 110. This packer 116 forces any wellbore fluids, indicated at 112, to enter and flow up the production tubing 110.

In a well like the well 100, the production tubing 110 is composed of tubulars, or individual sections of tubing, several of which are connected to one another to form the production tubing 110. Wellbore fluids 112 entering the production tubing 110 are then pumped by a TTC pump system 118 up to the well head 102 at the surface. From the well head 102, the fluids 112 are carried to one or more tanks for holding and/or further processing. In general, the TTC pump system 118 may be any pump system in which some or all of the components of the system are conveyed down the wellbore 104 through the production tubing 110. In the example shown, the TTC pump system 118 is an ESP based pump system, but other types of pump systems may also be used within the scope of the present disclosure, such as progressive cavity pump based systems, and the like.

In FIG. 1, the TTC pump system 118 has several main components, including a motor 120, a motor seal 122, a pump connector 124, and an ESP 126, all coupled to one another in the manner shown. These components are generally well known to those having ordinary skill in the art and therefore a description of their operation is omitted here for economy. Suffice it to say that the TTC pump system 118 allows the ESP 126 to be more easily deployed downhole by running it through the production tubing 110. Likewise, the ESP 126 can be more easily removed and replaced by passing it through the production tubing 110 without having to retrieve the entire pump assembly 118.

Note in the above example that the motor 120 is mounted within the production tubing 110 at the lower end thereof. It is also possible in some embodiments for the motor 120 to be mounted externally to the tubing 110, for example, at the end of the production tubing 110. The motor 120 is then run downhole with the production tubing 110 when the tubing is run downhole. After the motor 120 is run downhole, the ESP 126 and other components of the TTC pump system 118 can be conveyed through the production tubing 110 and coupled to the motor 120.

In accordance with embodiments of the present disclosure, a liquids reservoir 128 may be created from the generally annular space between the ESP 126 and the production tubing 110. The generally annular liquids reservoir 128 runs parallel to the annulus 114 and functions as a liquid trap to allow and/or redirect wellbore fluids 112 traveling up the production tubing 110 to flow back down into the reservoir 128. The sudden reversal in flow direction causes gas in the wellbore fluids 112 to separate from liquids, as the gas has a tendency to continue moving up rather than change direction with the liquids. This passive gas separation (i.e., no mechanical action) results in substantially gas-free liquids flowing down into the reservoir 128.

In some embodiments, the liquids reservoir 128 may be formed by sealing off the production tubing 110 below the ESP 126, for example, by providing a sealing element 130, such as a packer, in the annular space between the tubing 110 and the pump connector 124. The packer 130 is set immediately above one or more fluid outlet ports 132 that have been pre-formed in the production tubing 110 at a certain location along a length of the tubing. This outlet packer 130 forces wellbore fluids 112 traveling up the production tubing 110 to divert out through the outlet ports 132 and into the annulus 114.

The wellbore fluids 112 thereafter continue traveling up the annulus 114 until encountering one or more fluid inlet ports 134 that have been pre-formed in the production tubing 110 at a certain location along a length of the tubing. When that happens, the wellbore fluids 112 change direction and enter the fluid inlet ports 134, then flow down into the liquids reservoir 128 due to gravity. A sealing element 136, such as another packer, may be provided in the annular space between the tubing 110 and the ESP 126 immediately above the fluid inlet ports 134. This inlet packer 136 ensures the wellbore fluids 112 flow down into the liquids reservoir 128.

As the wellbore fluids 112 change direction and flow down into the liquids reservoir 128, gas in the fluids, indicated at 138, separate from the fluids and continues traveling up the annulus 114. This leaves substantially gas-free liquids flowing down into the reservoir 128. The substantially gas-free liquids are then taken into one or more intake ports 140 of the ESP 126 near the bottom of the reservoir 128. The ESP 126 then pumps the liquids up through an exit port 142 and back out into the production tubing 110. Because the liquids being pumped by the ESP 126 are substantially gas-free, the performance of the ESP 126 is not degraded, or is degraded to a much lesser degree.

When thus deployed, the ESP 126 is positioned such that the outlet packer 130 and the fluid outlet ports 132 are immediately below the intake ports 140 of the ESP 126. Similarly, the inlet packer 136 and the one or more fluid inlet ports 134 are immediately below the exit port 142 of the ESP 126. However, the inlet packer 136 and the fluid inlet ports 134 may also be located further down from the ESP 126, for example, adjacent to the middle portion of the ESP 126. Likewise, the outlet packer 130 and the fluid outlet ports 132 may be located further down from the ESP 126, for example, adjacent to the motor seal 122.

In some wells where the wellbore fluids are particularly gassy, the excessive amount of gas in the fluids can form sizable bubbles called "slugs" that can require more time to separate from liquids. When such gas slugs are present in the wellbore fluids, it has been observed that extending the distance that the wellbore fluids travel in the reverse direction (i.e., downward) can provide the additional time needed for the gas slugs to separate from the liquids. An example of this arrangement can be seen in FIG. 2.

Figure 2:
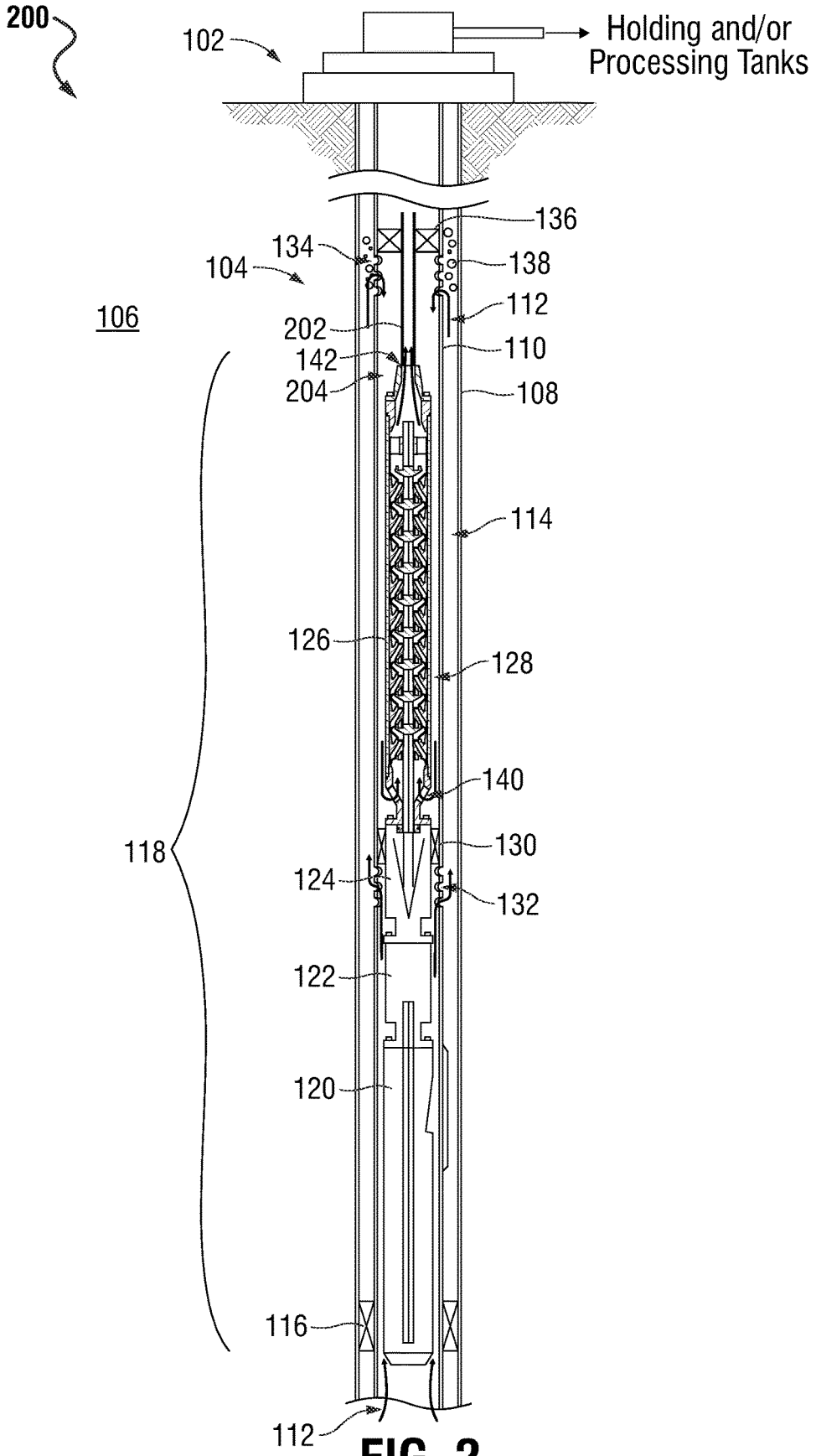
FIG. 2 is a schematic diagram of a well employing a TTC pump system with passive gas separation according to alternative embodiments of the present disclosure.

Referring to FIG. 2, a schematic diagram is shown for a well 200 employing a TTC pump system with passive gas separation according to an alternative embodiment of this disclosure. The well 200 is otherwise similar to the well 100 from FIG. 1 insofar as like reference numerals refer to like components and elements. Additionally, an extension pipe or tube 202, sometimes called a "stinger," is attached to the exit port 142 of the ESP 126. The extension pipe 202 serves to move the point where liquids exit the ESP 126 further up the production tubing 110. This allows the inlet packer 136 and the inlet ports 134 to be moved by a corresponding distance further up the production tubing 110 to immediately below the top end of the extension pipe 202, as shown. The result is a reservoir extension 204 that increases the distance that the wellbore fluids 112 flow in the reverse direction, thereby allowing more time for gas slugs to separate.

In some embodiments, the extension pipe 202 may be about 100 feet in length, although longer and shorter extension pipes may be used within the scope of the present disclosure. The extension pipe 202 may also have a uniform diameter that is the same as the diameter of the exit port 142 of the ESP 126 in some embodiments. Alternatively, the extension pipe 202 may have an expanding diameter such that the pipe resembles a cone, with the narrow end of the cone attached to the exit port 142. Various ways of attaching the extension pipe 202 to the exit port 142 are known to those skilled in the art.

Figure 3:
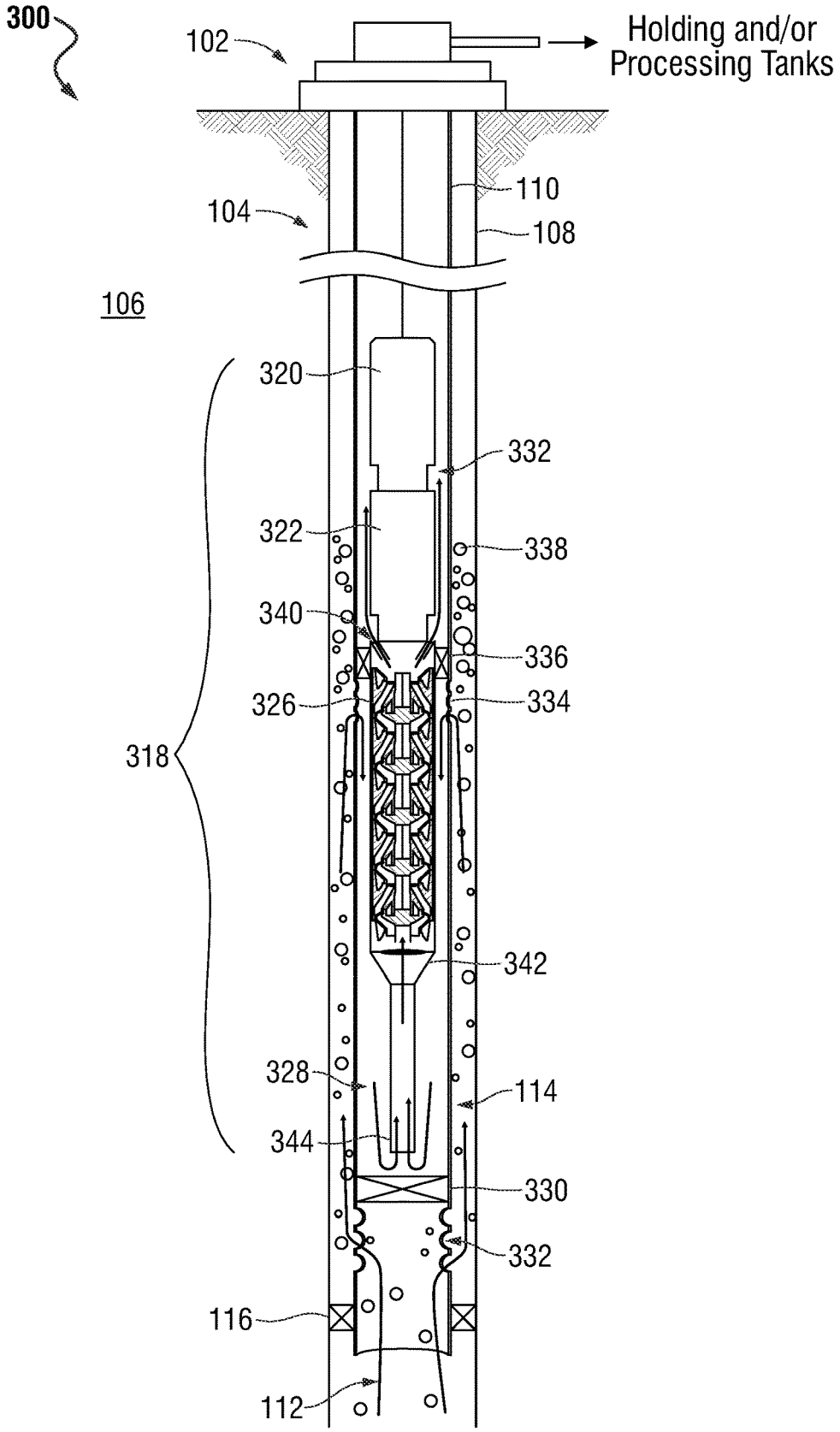
FIG. 3 is a schematic diagram of well employing a TTC pump system with passive gas separation according to other alternative embodiments of the present disclosure.

FIG. 3 is a schematic diagram of another well 300 employing a TTC pump system with passive gas separation according to embodiments of the present disclosure. Like the previous embodiments, the well 300 includes a well head 102 at the surface and a wellbore 104 extending into a formation 106. Casing 108 is again installed to provide structural support for the wellbore 104 and to protect the formation 106 from contamination. Production tubing 110 is again run through the casing 108 down the wellbore 104 to produce wellbore fluids 112 from the formation 106. The production tubing 110 and the casing 108 again form an annulus 114 that can be sealed off by setting a sealing element 116, such as a packer, in the annulus 114 near the fluid entrance to the tubing 110. The packer 116 forces any wellbore fluids, indicated at 112, to enter and flow up the production tubing 110.

A TTC pump system 318 pumps any wellbore fluids 112 entering the production tubing 110 up to the well head 102 at the surface. The TTC pump system 318 may again be any pump system in which some or all of the components of the system are conveyed down the wellbore 104 through the production tubing 110. In the example shown, the TTC pump system 318 is an ESP based pump system, but other types of pump systems may also be used within the scope of the present disclosure, such as progressive cavity pump based systems, and the like.

In the FIG. 3 example, the TTC pump system 318 includes a motor 320, a motor seal 322, and an ESP 326, all coupled to one another in the manner shown. However, the orientation of the TTC pump 318 has been reversed relative to its counterparts in FIGS. 1-2. That is, the motor 320 is positioned at the top of the system 318 and the ESP 326 is positioned at the bottom of the system. Operation of the TTC pump system 318 is otherwise similar to its counterparts in FIGS. 1-2, except the TTC pump system 318 runs in a counter direction to its counterparts. This means that liquids enter what is normally the exit port 342 of the ESP 326 and exit what is normally the intake ports 340.

In accordance with embodiments of the disclosure, a liquids reservoir 328 may again be created from the generally annular space between the ESP 326 and the production tubing 110. The generally annular liquids reservoir 328 runs parallel to the annulus 114 and functions as a liquid trap to allow and/or redirect wellbore fluids 112 traveling up the production tubing 110 to flow back down into the reservoir 328. The sudden reversal in flow direction again causes gas in the wellbore fluids 112 to separate from liquids. This passive (or non-mechanical) gas separation results in substantially gas-free liquids flowing down into the reservoir 328.

In some embodiments, the liquids reservoir 328 may be formed by sealing off the production tubing 310 below the ESP 326, for example, by providing a sealing element 330, such as a plug, in the production tubing 110. This outlet plug 330 is set below the ESP 326 and immediately above one or more fluid outlet ports 332 that have been pre-formed in the production tubing 310 at a certain location along the length of the tubing. The outlet plug 330 again forces wellbore fluids 312 traveling up the tubing 310 to exit through the outlet ports 332 and out into the annulus 114. The fluids travel up the annulus until encountering one or more fluid inlet ports 334 that have been pre-formed in the production tubing 110 at a certain location along the length of the tubing. A sealing element 336, such as another packer, is provided in the annular space between the tubing 110 and the ESP 326 immediately above the fluid inlet ports 334.

Gas separation occurs passively as described above, without mechanical action. Thus, as the wellbore fluids 112 change direction and flow down into the liquids reservoir 328, gas in the fluids, indicated at 338, separate from the fluids and continue traveling up the annulus 314. This leaves substantially gas-free liquids flowing down into the reservoir 328. The substantially gas-free liquids are then taken into the exit port 342 of the ESP 326 near the bottom of the reservoir 328. The ESP 326 thereafter pumps the liquids up through the intake ports 340 and back out into the production tubing 310.

In some embodiments, an extension pipe 344 similar to the extension pipe 202 from FIG. 2 may be attached to the exit port 342 where gas slugs are present. The extension pipe 344 extends the length that the wellbore fluids travel in the reverse direction down the reservoir 328, thereby providing more time for the gas slugs to separate from the liquids.

In the foregoing embodiments, the one or more fluid outlet ports 132/332 are pre-formed on a given tubular of the production tubing 110, and the one or more fluid inlet ports 134/334 are preferably pre-formed on the same tubular, offset by a predefined distance along the tubular. The predefined offset distance along the tubular is preferably about equal to the length of the ESP 126, and depends on the dimensions of the ESP. It is of course possible for the outlet ports 132/332 and the inlet ports 134/334 to be pre-formed on separate tubulars, respectively, depending on the particular needs of the well.

Figure 4:
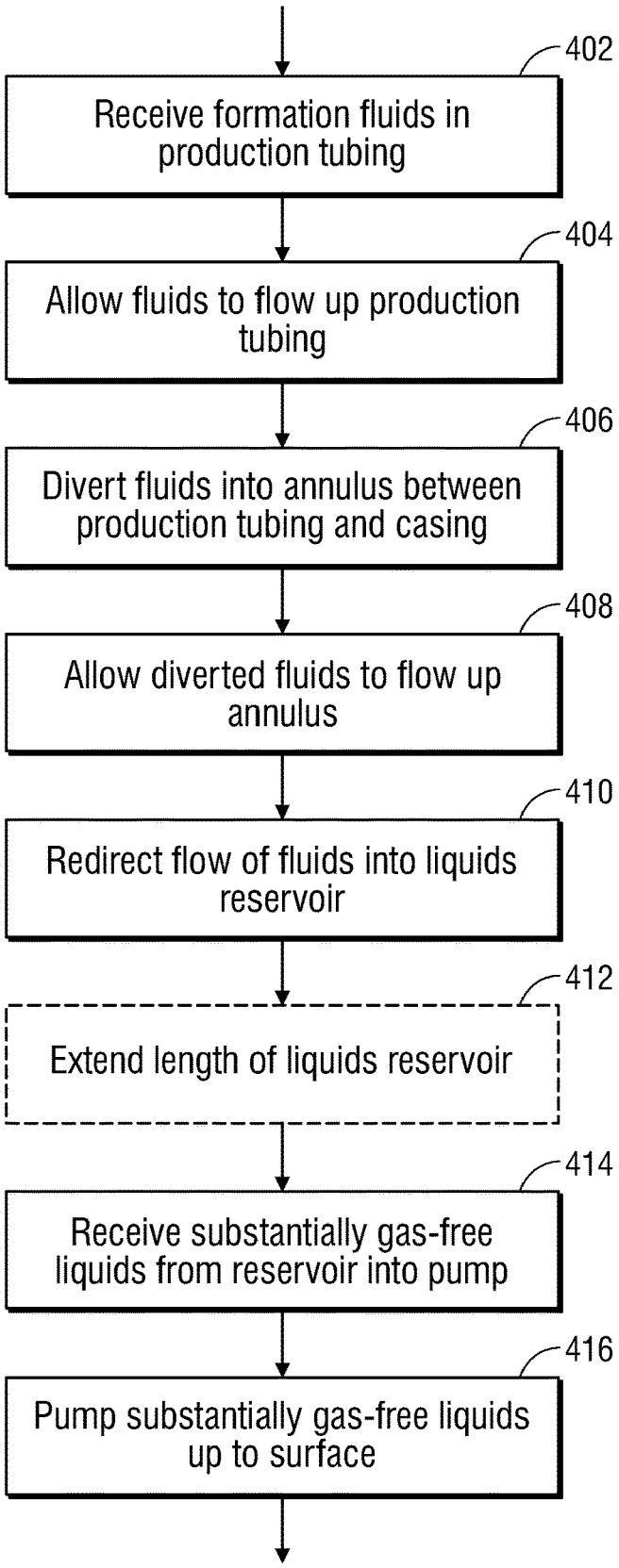
FIG. 4 is a flow diagram showing a method for providing passive gas separation in a TTC pump system according to embodiments of the present disclosure.

Referring now to FIG. 4, a flow diagram is shown for a method 400 that may be used to provide passive gas separation in a TTC pump system, such as an ESP based TTC pump system according to embodiments of this disclosure.

The method 400 generally begins at 402, where formation fluids are received in the production tubing of a cased wellbore, and the fluids are allowed to flow up the production tubing at 404. As discussed earlier, such formation fluids generally include a mix of gases and liquids, and it is desirable to separate the gases from the liquids, as the gas can degrade the performance of the pump assembly. Thus, at 406, the fluids are diverted from the production tubing into an annulus between the tubing and the casing. Preferably, the diversion of the fluids occurs immediately below the downhole end of the ESP, and may be accomplished by setting an outlet packer in the production tubing immediately above one or more pre-formed outlet ports in the production tubing, as described above.

At 408, the diverted fluids are allowed to flow up the annulus until at 410, the flow direction of the fluids changes when the fluids enter and flow down into a liquids reservoir formed between the tubing and the ESP. The flow direction change causes gas in the fluids to separate from liquids, as the gas has a tendency to continue going up instead of changing direction with the liquids. Preferably, the gas separation occurs immediately below the uphole end of the ESP, and may be accomplished by setting an inlet packer in the production tubing immediately above one or more pre-formed inlet ports in the production tubing, as described above.

In some embodiments, as an option at 412, the length of the liquids reservoir may be extended, for example, by attaching an extension pipe or tube to either the intake port or the exit port of the ESP. In either case, substantially gas-free liquids from the liquids reservoir are then received into the ESP at 414, and the ESP pumps the substantially gas-free liquids up to the surface at 416.

Accordingly, as set forth herein, embodiments of the present disclosure may be implemented in a number of ways. For example, in one aspect, embodiments of the present disclosure relate to an apparatus for passive separation of gas for a TTC pump system. The apparatus comprises, among other things, casing for a wellbore in a subterranean formation, and production tubing extendable through the casing to define an annulus with the casing, wherein a pump of the TTC pump system can be conveyed through the production tubing. The apparatus further comprises a generally annular liquids reservoir formed between the production tubing and the pump when the pump is deployed in the production tubing, the liquids reservoir running parallel to the annulus. Wellbore fluids, when flowing up the annulus, are redirected down into the liquids reservoir, the redirecting of the wellbore fluids causing gas in the wellbore fluids to separate from liquids in the wellbore fluids.

In general, in another aspect, embodiments of the present disclosure relate to a well having a TTC pump system and passive gas separation. The well comprises, among other things, casing installed in a wellbore in a subterranean formation, and production tubing extending through the casing, the production tubing and the casing defining an annulus therebetween. The well further comprises a pump of the TTC pump system deployed in the production tubing at a predefined location along a length of the production tubing, and a generally annular liquids reservoir formed between the production tubing and the pump and running parallel to the annulus. Wellbore fluids flowing up the annulus are redirected down into the liquids reservoir, the redirecting of the wellbore fluids causing gas in the wellbore fluids to separate from liquids in the wellbore fluids.

In general, in yet another aspect, embodiments of the present disclosure relate to a method of passive gas separation for a TTC pump system. The method comprises, among other things, receiving wellbore fluids in a production tubing, the wellbore fluids flowing up the production tubing, and diverting the wellbore fluids from the production tubing into an annulus formed between the production tubing and a casing through which the production tubing extends. The method further comprises redirecting the wellbore fluids from the annulus down into a generally annular liquids reservoir formed between the production tubing and a pump of the TTC pump system, the liquids reservoir running parallel to the annulus. The redirecting of the wellbore fluids into the liquids reservoir causes gas in the wellbore fluids to separate from liquids in the wellbore fluids.

In accordance with any one or more of the foregoing embodiments, one or more fluid outlet ports are formed in the production tubing at a predefined location along the production tubing, wherein wellbore fluids flowing up the production tubing are diverted into the annulus through the one or more fluid outlet ports.

In accordance with any one or more of the foregoing embodiments, one or more fluid inlet ports are formed in the production tubing at a predefined location along the production tubing, wherein wellbore fluids flowing up the annulus are redirected through the one or more fluid inlet ports down into the liquids reservoir.

In accordance with any one or more of the foregoing embodiments, the production tubing comprises multiple tubulars connected to one another and the one or more fluid outlet ports and the one or more fluid inlet ports are formed on the same tubular.

In accordance with any one or more of the foregoing embodiments, an outlet sealing element is disposed in the production tubing above the one or more fluid outlet ports and below the pump. The outlet sealing element is one of a packer or a plug.

In accordance with any one or more of the foregoing embodiments, an inlet sealing element is disposed in the production tubing above the one or more fluid inlet ports between the pump and the production tubing.

While the disclosure has been described with reference to one or more particular embodiments, those skilled in the art will recognize that many changes may be made thereto without departing from the spirit and scope of the description. Each of these embodiments and obvious variations thereof is contemplated as falling within the spirit and scope of the claimed disclosure, which is set forth in the following claims.

What is claimed is:

1. A through-tubing-conveyed (TTC) pump system providing passive gas separation, comprising:

a motor;

a motor seal disposed downhole of and coupled to the motor;

a pump disposed downhole of and coupled to the motor seal;

an intake pipe coupled to an inlet of the pump and extending downhole from the inlet of the pump;

production tubing interiorly retaining the motor, the motor seal, the pump, and the intake pipe, wherein the production tubing defines a first plurality of ports disposed downhole of a downhole open end of the intake pipe, and wherein the production tubing defines a second plurality of ports disposed downhole of the motor seal and proximate an uphole end of the pump; and a first seal that seals an interior of the production tubing downhole of the intake pipe and uphole of the first plurality of ports.

2. The TTC pump system of claim 1, wherein the production tubing comprises multiple tubulars connected to one another, wherein the first plurality of ports and the second plurality of ports are defined by a same one of the multiple tubulars.

3. The TTC pump system of claim 1, further comprising a second seal disposed around an outside of the production tubing downhole of the first plurality of ports defined by the production tubing and a third seal disposed around an outside of the pump and inside of the production tubing, wherein the second seal is configured to form a seal between the outside of the production tubing and an inside of a casing in a wellbore, wherein the first seal and the second seal are configured to direct wellbore fluids to flow uphole in an interior of the production tubing below the first plurality of ports and to flow outwards through the first plurality of ports into a first annulus defined between the outside of the production tubing and the inside of the casing, wherein the third seal is configured to form a seal between the outside of the pump and an inside of the production tubing, wherein the third seal is configured to form a seal between the outside of the pump and the inside of the production tubing, and wherein the first seal and the third seal are configured to direct wellbore fluids flowing uphole in the first annulus to flow in through the second plurality of ports into a second annulus defined between an outside of the pump and an outside of the intake pipe and an inside of the production tubing between the first seal and the third seal, to flow downhole in the second annulus, and to flow into the intake pipe.

4. The TCC pump system of claim 3, wherein the second seal is a packer.

5. The TCC pump system of claim 1, wherein the intake pipe is about 100 feet long.

6. The TCC pump system of claim 1, wherein the first seal is a plug.

7. A through-tubing-conveyed (TTC) pump system providing passive gas separation, comprising:

a motor;

a motor seal coupled to the motor;

a pump coupled to the motor seal;

production tubing interiorly retaining the motor, the motor seal, and the pump, wherein the production tubing defines a first plurality of ports disposed downhole of an inlet of the pump, wherein the production tubing defines a second plurality of ports disposed uphole of the inlet of the pump, and wherein the motor seal and the pump are configured to be conveyed through the production tubing;

a first seal disposed around an outside of the production tubing downhole of the first plurality of ports defined by the production tubing, wherein the first seal is configured to form a seal between the outside of the production tubing and an inside of a casing in a wellbore and to direct wellbore fluids to flow uphole in an interior of the production tubing below the first plurality of ports and to flow outwards through the first plurality of ports into a first annulus defined between the outside of the production tubing and the inside of the casing;

a second seal disposed around an outside of a pump connector and an inside of the production tubing uphole of the first plurality of ports defined by the production tubing, wherein the second seal is configured to form a seal between the outside of the pump connector and the inside of the production tubing, wherein the pump connector couples the pump to the motor seal; and a third seal disposed around an outside of an exit port of the pump and inside of the production tubing uphole of the second plurality of ports defined by the production tubing, wherein the third seal is configured to form a seal between the outside of the exit port of the pump and the inside of the production tubing, and wherein the second seal and the third seal are configured to direct wellbore fluids flowing uphole in the first annulus to flow in through the second plurality of ports into a second annulus defined between an outside of the pump and an inside of the production tubing between the second seal and the third seal, to flow downhole in the second annulus, and to flow into an intake of the pump.

8. The TTC pump system of claim 7, wherein the production tubing comprises multiple tubulars connected to one another, wherein the first plurality of ports and the second plurality of ports are defined by a same one of the multiple tubulars.

9. The TTC pump system of claim 7, wherein the exit port of the pump comprises an extension tube that extends uphole and the third seal is disposed around an outside of an uphole end of the extension tube, wherein the third seal is configured to form a seal between the outside of the extension tube and the inside of the production tubing.

10. The TTC pump of claim 9, wherein the extension pipe is about 100 feet long.

11. The TTC pump system of claim 9, wherein the extension tube expands in diameter as it extends uphole.

12. The TTC pump system of claim 7, wherein the first seal is a packer.

13. The TTC pump system of claim 7, wherein the pump is configured to be deployed downhole by running it through the production tubing and to be removed by passing it through the production tubing without having to remove the motor and the motor seal.

14. The TTC pump system of claim 7, wherein the pump is a centrifugal pump.

15. The TTC pump system of claim 7, wherein the pump is a progressive cavity pump.

16. A method of lifting wellbore fluid in a wellbore to a surface by a through-tubing-conveyed (TTC) pump system, comprising:

receiving wellbore fluids into a downhole end of a production tubing interiorly retaining the TTC pump system, wherein the production tubing defines a first plurality of ports disposed downhole of an inlet of a pump of the TCC pump system and a second plurality of ports disposed uphole of the inlet of the pump of the TCC pump system, wherein the production tubing comprises multiple tubulars connected to one another;

diverting the wellbore fluids from an interior of the production tubing out through the first plurality of ports into an annulus formed between the production tubing and a casing through which the production tubing extends;

redirecting the wellbore fluids from the annulus through the second plurality of ports downhole into a generally annular liquids reservoir formed between the production tubing and the pump of the TTC pump system, the liquids reservoir running parallel to the annulus; and separating gas from liquid in the wellbore fluid by redirecting the wellbore fluids in a downhole direction into the liquids reservoir.

17. The method of claim 16, further comprising setting an outlet sealing element in the production tubing above first plurality of ports and below the pump.

18. The method of claim 16, further comprising setting an inlet sealing element in the production tubing above the second plurality of ports between the pump and the production tubing.

19. The method of claim 16, further comprising flowing the wellbore fluid uphole in an extension pipe coupled to a downhole end of the pump to the pump.

20. The method of claim 16, wherein the liquids reservoir is further defined between the production tubing and an outside of an extension pipe coupled to an exit port of the pump that extends uphole from the exit port of the pump, wherein the extension pipe is about 100 feet long.

* * * * *